US005471698A

United States Patent [19]

Francis et al.

[11] Patent Number: 5,471,698

[45] Date of Patent: Dec. 5, 1995

[54] HAND TOOL HAVING INTERCHANGEABLE ACCESSORIES

[75] Inventors: Paul S. Francis; Teryl K. Rouse, both of Kansas City, Mo.

[73] Assignee: Innovation Development, Inc., Kansas City, Mo.

[21] Appl. No.: 157,305

[22] Filed: Nov. 26, 1993

[51] Int. Cl.[6] ..... B25G 1/00; A47K 13/12

[52] U.S. Cl. ..... 15/144.1; 15/145; 15/229.13; 15/236.02; 15/236.05; 16/126; 16/112; 16/114 R; 7/158; 451/344; 451/557; 451/529

[58] Field of Search ..... 15/105, 107, 110, 15/111, 114, 117, 143.1, 144.1, 145, 104.53, 176.1, 209.4, 229.13, 236.01, 236.02, 236.05, 244.4; 16/111 R, 114 R, 112, 126; 51/205 R, 170 R, 392, 393, 180, 382, 387; 81/489; 7/100, 158, 168, 167; 30/169, 170, 171, 172, 298

[56] References Cited

U.S. PATENT DOCUMENTS

| | | | |
|---|---|---|---|
| 926,458 | 6/1909 | Beeler | 30/170 |
| 969,528 | 9/1910 | Disbrow | 30/169 |
| 1,219,763 | 3/1917 | Pearce . | |
| 1,916,649 | 7/1933 | Appleford | 15/231 |
| 2,236,093 | 3/1941 | Friend | 30/172 |
| 2,290,375 | 7/1942 | Macias | 15/114 |
| 2,846,764 | 8/1958 | Hyneman . | |
| 4,114,321 | 9/1978 | Jarvis et al. | 51/205 R |
| 4,305,175 | 12/1981 | Burgess, Jr. | 15/236.05 |
| 4,549,350 | 10/1985 | Patillo | 15/236.05 |
| 4,813,458 | 3/1989 | Jacobucci | 15/236.02 |
| 4,885,876 | 12/1989 | Henke | 51/392 |
| 4,888,846 | 12/1989 | Natale | 15/145 |
| 4,962,561 | 10/1990 | Hamilton | 15/236.02 |
| 4,984,324 | 1/1991 | Farris . | |
| 5,179,807 | 1/1993 | Gupton | 51/170 R |

FOREIGN PATENT DOCUMENTS

| | | | |
|---|---|---|---|
| 530172 | 12/1921 | France . | |
| 803481 | 10/1936 | France | 15/229.13 |
| 1000437 | 10/1951 | France | 15/145 |
| 853488 | 10/1952 | Germany | 15/236.05 |
| 571594 | 1/1958 | Italy | 15/229.13 |
| 204799 | of 0000 | Switzerland | 30/172 |
| 197803 | 3/1978 | Switzerland . | |

*Primary Examiner*—David A. Scherbel
*Assistant Examiner*—Tony G. Soohoo
*Attorney, Agent, or Firm*—Kokjer, Kircher, Bowman & Johnson

[57] ABSTRACT

A hand tool having a frame which holds interchangeable working heads for scraping ice and other materials, scrubbing and sanding. The frame pivotally carries the working head at one end and has a curved forearm brace at the other end. A hand grip bar is located between the ends of the frame such that the forearm provides force against the brace to hold the working head against the work surface. This creates a leverage effect and relieves stress on the wrist. The pivotal head allows angled or contoured surfaces to be followed without requiring the wrist to flex at different angles. The scraping head has two scraping edges which scrape on both push and pull strokes. An accessory head which is interchangeable with the ice scraping head can hold two metal scraping blades or interchangeable base plates which provide a sanding sheet and a scrubbing pad, respectively.

15 Claims, 2 Drawing Sheets

HAND TOOL HAVING INTERCHANGEABLE ACCESSORIES

FIELD OF THE INVENTION

This invention relates generally to hand tools and more particularly to a hand held implement which interchangeably holds different devices for scraping ice and snow, for more difficult scraping operations that require a metal scraping blade, for scrubbing various surfaces, and for sanding operations.

BACKGROUND OF THE INVENTION

A variety of different types of scrapers have been available for the scraping of ice and snow from vehicle windows and for carrying out other hand scraping operations such as those involving the scraping of paint and wallpaper from walls and other surfaces. Conventional scrapers have a handle which is grasped in the hand and used to press the scraping edge of the tool against the surface that is being scraped. This manner of scraping exerts considerable stress on the wrist and requires the wrist to be flexed at various angles, thus frequently leading to wrist injuries. The force that can be applied to the surface is also somewhat limited because of the limited strength of the wrist, and this detracts from the effectiveness and efficiency of the scraping process. Fatigue of the wrist and hand is a common problem when extensive scraping is required.

The problems associated with conventional scrapers have been recognized, and efforts to improve the scraper design have been made. However, they have not been altogether successful either functionally or commercially. For example, the scraper shown in U.S. Pat. No. 4,813,458 to Jacobucci has a construction presenting a curved scraper end that the forearm works against to increase the leverage. Because the thin edge of the curved scraper end contacts the forearm, full advantage of leverage is not taken, and the forearm is subject to bruises and other injury. The wrist must still be flexed at various angles, especially when a curved windshield or other curved or uneven surface is being scraped. The scraping is done wholly with a pushing stroke, and the return stroke does no work.

U.S. Pat. No. 4,888,846 to Natale discloses a scraper that is intended for use to scrape asbestos from vertical surfaces. Although a ring is provided for receiving the arm, the ring is not used for leverage but instead serves as a support intended to decrease the discomfort of the arm. The handle is held in a pistol grip fashion such that the scraping force is wholly applied through the wrist and hand with little if any leverage effect that makes use of the forearm. Again, the scraping is done entirely with pushing motion, and the wrist must be flexed at different angles as the work proceeds.

Problems similar to those involved in scraping processes are encountered with other operations that require the application of force by a hand held implement. These include scrubbing of floors, walls, tiles, vehicle surfaces and the like and sanding of wood, drywall, vehicles, and other surfaces. Typically, a different tool is required for each different application. Thus, an ice scraper is usually required for scraping vehicle windows, another type of scraper with a metal blade is required to scrape paint and other materials from walls, another tool is needed to carry out scrubbing, and still another device is required for hand sanding operations. The need for all of these different implements increases the cost and also creates problems relating to storage of the different tools when they are not being used and having them available when they are needed.

SUMMARY OF THE INVENTION

The present invention is directed to an improved hand tool which exhibits advantageous ergonomic characteristics, effective use of leverage, working strokes in both the push and pull directions, a pivotal working head which avoids awkward flexture of the wrist, and interchangeability of different working implements on a single frame. In accordance with the invention, a rigid frame includes opposite sides which carry a pivotal working head at one end and have a curved forearm brace at the other end. Intermediate the ends, a hand grip bar extends between the opposite sides of the frame. This construction provides a firm and comfortable grip and allows the working head to be pressed forcefully against the work surface by reason of the leverage that can be applied by the application of the forearm to the forearm brace. At the same time, the wrist can be maintained in a comfortable posture such that it does not need to be flexed at different angles and is not subject to significant strain. This greatly reduces wrist injuries and fatigue, while allowing the stronger forearm area to apply most of the scraping force in order to increase the effectiveness of the scraping action while reducing muscle fatigue. It is a particularly important feature of the invention that different working heads can be used for different applications. For example, one working head is an ice scraper characterized by scraping edges on both its leading and trailing ends. The leading edge provides scraping action on the push stroke, and the trailing edge scrapes on the return or pull stroke. By scraping the surface on both the push and pull strokes, the scraping operation can be completed more quickly and easily than is possible with a single edged scraping tool.

Another accessory head having a detachable base plate is interchangeable with the ice scraping head. When the base plate of the accessory head is removed, a pair of metal scraping blades can be secured to the accessory head for the scraping of paint, wallpaper and other materials that require the application of substantial scraping force. When the scraping blades are removed, the accessory head can receive a pair of interchangeable base plates, one of which carries a hook backing for the attachment of scrubbing pads and the other of which carries a sanding sheet backed by a suitable pad.

By reason of its unique construction, the hand tool of the present invention is highly versatile because of the different operations that can be carried out with it, is more effective than conventional tools because of the leverage that can be applied by the forearm, is less likely to lead to wrist injuries or fatigue because the wrist is not flexed at different angles and much of the rotational force is transferred to the forearm, and is able to closely follow different surface contours because of the pivotal working heads.

DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figure 1:
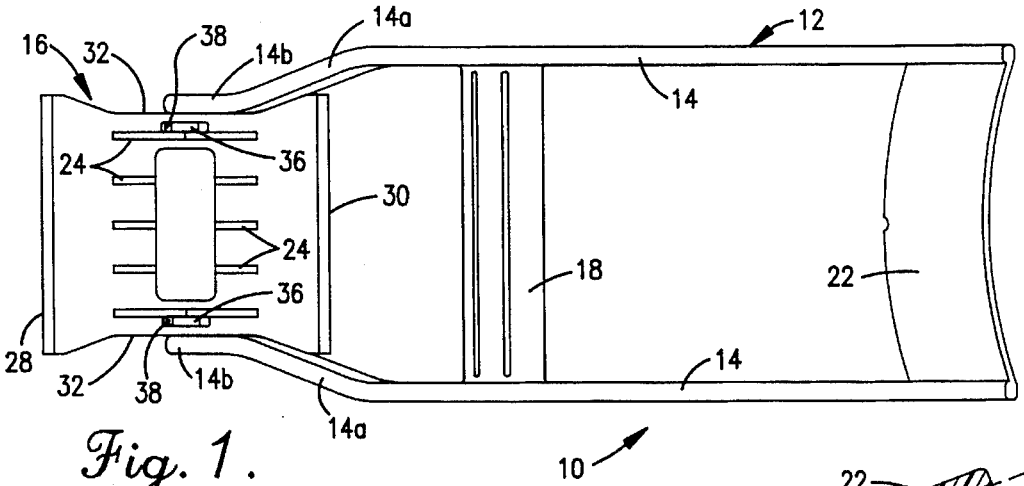
FIG. 1 is a top plan view of a hand tool constructed according to a preferred embodiment of the present invention, with an ice scraping head in place on the frame of the tool.
Figure 2:
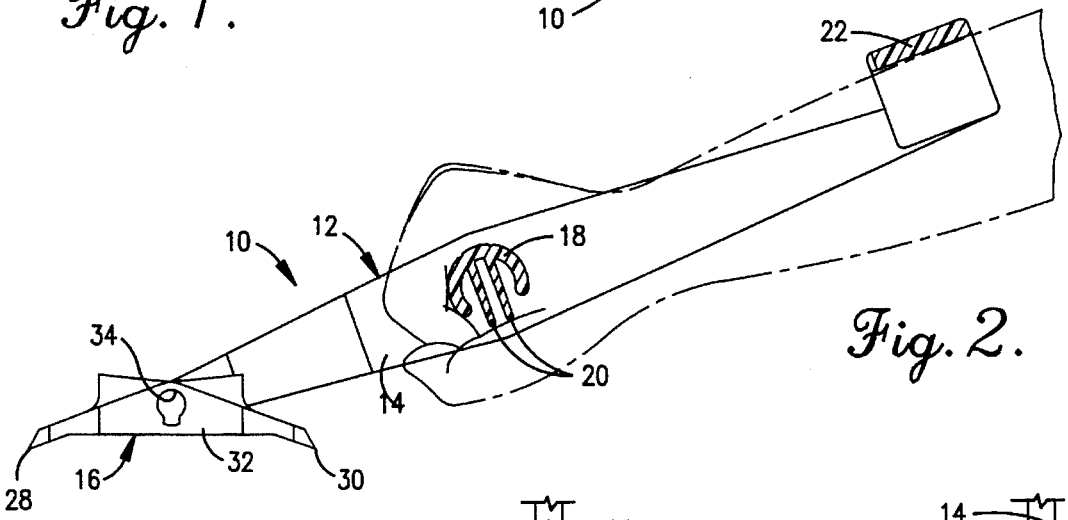
FIG. 2 is a side elevational view, partially in section, showing the manner in which the tool of FIG. 1 is held while being used for the scraping of ice and snow.

Referring now to the drawings in more detail and initially to FIGS. 1 and 2, numeral 10 generally designates a hand held tool or implement constructed in accordance with a preferred embodiment of the present invention. The tool 10 has a rigid frame which is generally identified by numeral 12 and which includes a pair of opposite sides 14. The sides 14 are parallel to one another for the majority of their length. Near the front end of the tool 10, the sides 14 have angled portions 14*a* that taper or converge somewhat as they extend forwardly. The arms 14 terminate in forward ends 14*b* which are spaced apart and parallel to one another. As will be explained more fully, interchangeable accessory heads such as the ice scraping head 16 can be mounted for pivotal movement between the forward ends 14*b* of the frame sides.

A hand grip bar 18 extends between the opposite sides 14 of the frame at a location slightly to the rear of the tapered portions 14*a*. As best shown in FIG. 2, the bar 18 is generally semi-cylindrical and has a smoothly curved top portion. A pair of flat reinforcing ribs 20 are formed integrally with the bar 18 and extend between the opposite sides 14 to strengthen and stiffen the bar 18 and the entire frame 12. The bar 18 has a size to be closely gripped with the hand of a user, as best shown in FIG. 2.

A forearm brace 22 extends between the rearward ends of the frame sides 14 at the end of the frame opposite the working head 16. The brace 22 takes the form of a smoothly curved band having a concave surface which faces generally downwardly or toward the forearm of a user whose hand is applied to the grip bar 18. The curvature of the brace 22 conforms generally with that of the forearm of the user of the implement. The brace 22 is arranged such that it presents a relatively large area for contact against the forearm and does not present any edges that are engaged with the forearm.

Preferably, the frame 12 is formed integrally such that the sides 14, hand grip 18 and forearm brace 22 are provided as a single molded piece.

The ice scraping head 16 has a body that is reinforced on its top surface by a plurality of parallel ribs 24 can function to break up ice when the head is flipped over. The underside of the body is reinforced with somewhat larger and longer ribs 26 (see FIG. 3). The leading end of the body of the scraper head 16 terminates in a sharp scraping edge 28. The opposite or trailing end of the head 16 is provided with a similar scraping edge 30. As shown in FIG. 2, the scraping edges 28 and 30 project below the remainder of the body of the accessory head 16 such that they provide the sole places of contact between the scraping head and a surface to which it is applied. The edges 28 and 30 are oriented such that the leading edge 28 acts to scrap ice and snow from a surface when the tool is pushed in a forward direction, while the trailing edge 30 provides similar scraping action on the return or pull stroke of the tool.

Figure 3:
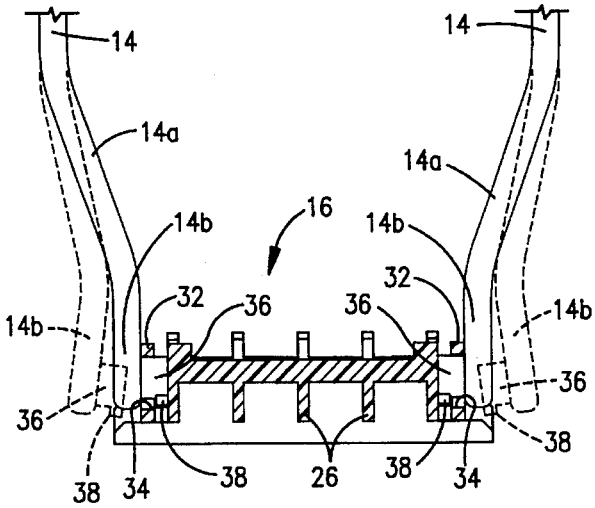
FIG. 3 is a fragmentary top plan view on an enlarged scale, partially in section, showing the ice scraping head rotated approximately 90° from the position of FIG. 2, with the broken lines showing how the sides of the tool frame can be flexed in order to release the head from the frame.
Figure 4:
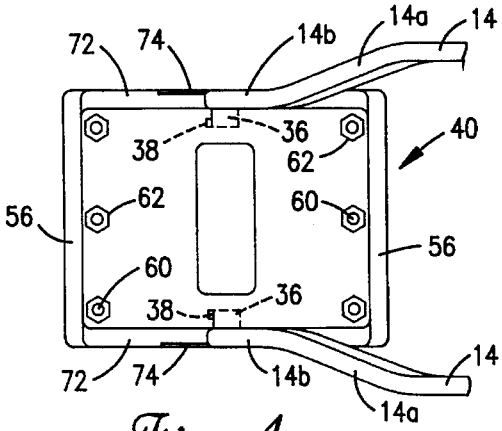
FIG. 4 is a fragmentary top plan view of the tool, with an alternative interchangeable accessory head installed in place of the ice scraping head.

The body of the accessory head 16 has opposite sides 32. Near its center, each of the sides 32 presents a key hole shaped opening or slot 34 (see FIG. 2 in particular). As best shown in FIG. 3, cylindrical pins 36 project inwardly from the forward ends 14*b* of the frame sides 14. The pins 36 are axially aligned and have a size to fit closely in the main circular portions of the key hole openings 34. On its inner tip, each pin 36 has a radially projecting lug 38 having a size to fit closely through the smaller portion of the key hole opening 34. The lugs 38 are spaced away from the end portions 14*b* a distance slightly greater than the thickness of the corresponding side 32 of the scraping head 16.

The ice scraping head 16 can be installed on the frame 12 by holding it in the rotative position shown in FIG. 3 where the small portions of the key hole slots 34 align with the lugs 38 of pins 36. The forward ends 14*b* of the frame sides can then be flexed apart as shown in broken lines in FIG. 3, and the accessory head 16 can then be slipped between the ends 14*b*. When the sides 14*b* are released, they flex back toward one another, and the pins 36 enter the circular portions of the keyhole slots 34. The lugs 38 pass through the smaller portions of the key hole slots 34. When the head 16 is thereafter rotated, the lugs 38 are engaged against the inside surfaces of the opposite sides 32 of the scraping head 16. The fit of the lugs 38 against the inside surfaces of the sides 32 mounts the head 16 in place on the tool. The head 16 is allowed to pivot about the pivot axis provided by the axially aligned pins 36. The pivot axis about which the head 16 can turn is parallel to the scraping edges 28 and 30 and to the grip bar 18.

It is noted that the rotative position in which the lugs 38 and the small portions of the slots 34 are in alignment is one in which a plane containing both of the scraping edges 28 and 30 is generally perpendicular to the sides 14. As shown in FIG. 2, the tool 10 is used with the head 16 at a completely different rotative position such that there is little chance of the lugs 38 inadvertently slipping out of the key hole slots 34 during use of the tool. However, when it is desired to remove the scraping head 16, it can easily be rotated to the aligned position and the ends 14*b* can be flexed apart to withdraw the pins 36 and lugs 38 from the key hole openings, thus releasing the scraping head 16.

When the scraping head 16 is in place, the tool 10 can be used to scrape ice and snow from vehicle windows, windshields and other surfaces. The tool is used by gripping it in the manner shown in FIG. 2, with the hand clenched around the grip bar 18 and the forearm engaged against the undersurface of the forearm brace 22. The ice scraping head 16 is applied to the surface that is to be scraped, and the arm is moved forward in a pushing stroke during which the leading scraping edge 28 acts to scrape ice and snow off of the windshield or window surface. At the end of the push stroke, the tool is pulled rearwardly, and the trailing scraping edge 30 then acts to scrape ice and snow from the surface. It is thus evident that scraping action is accomplished in both the push and pull directions such that the scraping operation is effectively completed twice as fast as in the case of a tool with a single scraping edge.

It is particularly noteworthy that the tool is constructed to provide enhanced leverage that allows the scraping to take place forcefully. During both the push and pull scraping strokes, the forearm acts upwardly against the brace 22, while the hand presses downwardly on the grip bar 18. Because the brace 22 is located a considerable distance from the grip bar which provides a fulcrum for the lever action, and the scraping head 16 is located relatively closely to the grip bar, the forces are amplified by the effect of leverage. The result is that the force applied to the scraping head is enhanced considerably compared to what is achieved with a conventional scraper. Equally significant, much of the rotational force is transferred past the wrist to the stronger forearm which is supported by the larger muscle groups (shoulder, back and chest). The wrist of the user can remain stationary in a comfortable position and need not flex among different positions as the scraping proceeds. The scraping head 16 naturally pivots as it moves along the surface that is being scraped and naturally conforms to its curvature and other irregularities without requiring flexture of the wrist. This, combined with the fact that the force is applied mainly by the relatively strong forearm area, reduces the strain on the wrist and muscle fatigue in general, thus reducing the physical discomfort on the user and the risk of wrist injury.

The ice scraping head 16 can be removed from the frame 12 in the manner previously described and replaced by a different working head such as the accessory head identified by numeral 40 in FIGS. 4–9. The accessory head 40 has a construction allowing it to be releasably mounted on the front end of the frame 12 in a manner substantially identical to that described for the ice scraping head 16. The head 40 has opposite sides 42 which present key hole slots 44 (see FIGS. 5 and 9 in particular) for receiving the pins 36 and lugs 38 in the same manner described in connection with the ice scraping head 16.

Figure 7:
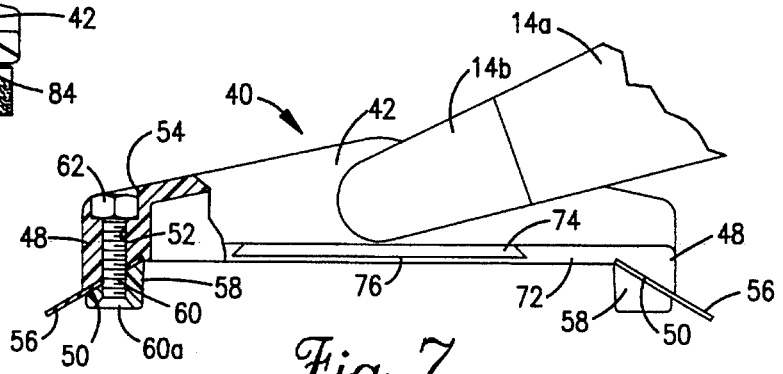
FIG. 7 is a fragmentary enlarged view, partially in section, showing a pair of metal scraper blades installed on the accessory head.
Figure 9:
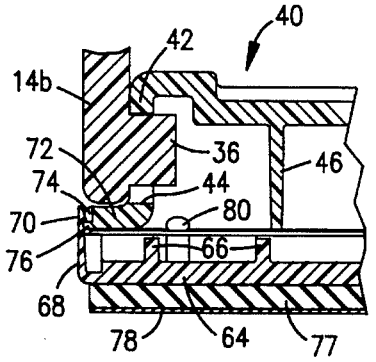
FIG. 9 is a fragmentary sectional view on an enlarged scale taken generally along line 9—9 of FIG. 8 in the direction of the arrows.

The body of the head 40 is open at the bottom and is provided with parallel reinforcing ribs 46 (see FIG. 9). The body of the accessory head has front and back walls 48 which, as best shown in FIG. 7, present inclined surfaces 50 on their lower ends. A plurality of openings 52 extend upwardly into each of the surfaces 50 and have hexagonal counter bore recesses 54 in their top ends adjacent to the top of the accessory head body.

A pair of flat metal scraping blades 56 may be secured to the inclined surfaces 50. Each blade 56 has a wedge shaped keeper 58 having openings through it that align with the openings 52. The openings through the wedges 58 have counter sink areas for receiving the heads 60*a* of machine bolts 60 that may be extended through the keepers 68 and passages 52 into the counter sink areas 54. Nuts 62 may be threaded onto the bolts 60 in order to secure the keepers 58 and the blades 56 in place on the accessory head 40. When the blades 56 are secured in place as shown in FIG. 7, their scraping edges extend below the underside of the accessory head 40 and the keepers 58, with one blade 56 on the leading end of the head 40 and the other blade on the trailing edge. The tool 10 can be used to effect scraping with the two blades 56 in substantially the same manner described previously for ice scraping operations. It is contemplated that the metal blades 56 will be used for scraping operations such as those involving the removal of paint, wallpaper and other imperfections from walls and other surfaces that require heavy duty scraping.

The accessory head 40 is equipped with a detachable base plate 64 which can be detachably connected to the bottom of the accessory head 40 when the blades 56 and keepers 58 are removed. As best shown in FIG. 9, the base plate 64 is a generally planar plate having short reinforcing ribs 66 on its top surface. On its opposite sides, the plate 64 has upwardly extending flanges 68. The top or free edge of each flange 68 has a hook type lug 70 which projects inwardly.

The opposite sides of the accessory head 40 are provided with ledges 72 which extend outwardly from the bottom ends of the sides 42. The outer edge of each ledge 72 is recessed at 74 to provide a small shoulder or lip 76 on which the lug 70 can be hooked in order to secure the plate 64 in place on the under side of the body of the accessory head 40. The plate 64 can be detached by flexing the flanges 68 outwardly such that the lugs 70 disengage from the lips 76, thus releasing the base plate 64 so that it can be removed from the accessory head.

Figure 8:
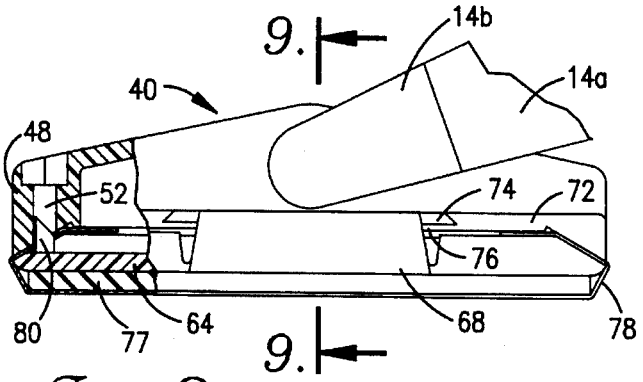
FIG. 8 is an enlarged fragmentary view similar to FIG. 7, but showing a sanding sheet and backing pad installed on the accessory head in place of the scraping blades, with a portion shown in section for purposes of illustration.

A rubber pad 77 is glued or otherwise secured to the bottom surface of the base plate 64. The pad 77 provides a base for a sanding sheet 78 which may be a conventional sheet of sand paper cut to the proper size. As shown in FIG. 8, the ends of the sanding sheet 78 are drawn upwardly over the front and back edges of the base plate 64. The front and back edges of the plate 64 are provided with a plurality of upwardly projecting pins 80 which present pointed tips. The ends of the sanding sheet 78 are drawn over the tips 80 and are impaled on them to secure the sanding sheet to the base plate 64 with the sheet held in a tight condition by the pins 80. The base plate 64 can then be applied to the under side of the accessory head 40, with the lugs 70 hooking on and interlocking with the lip 76 to hold the base plate in place. The pins 80 are located such that they extend into the openings 52 of the accessory head.

With the base plate holding the sanding sheet 78 in place on the accessory head 40, the tool 10 can be used in sanding operations in substantially the same manner described previously in connection with scraping operations. The pivotal mounting of the accessory head 40 allows the sheet 78 to remain flatly against the surface that is being sanded, and it is noted that sanding takes place on both the push and pull strokes of the tool. The leverage effect previously described is significant in enhancing the sanding operation.

Figure 6:
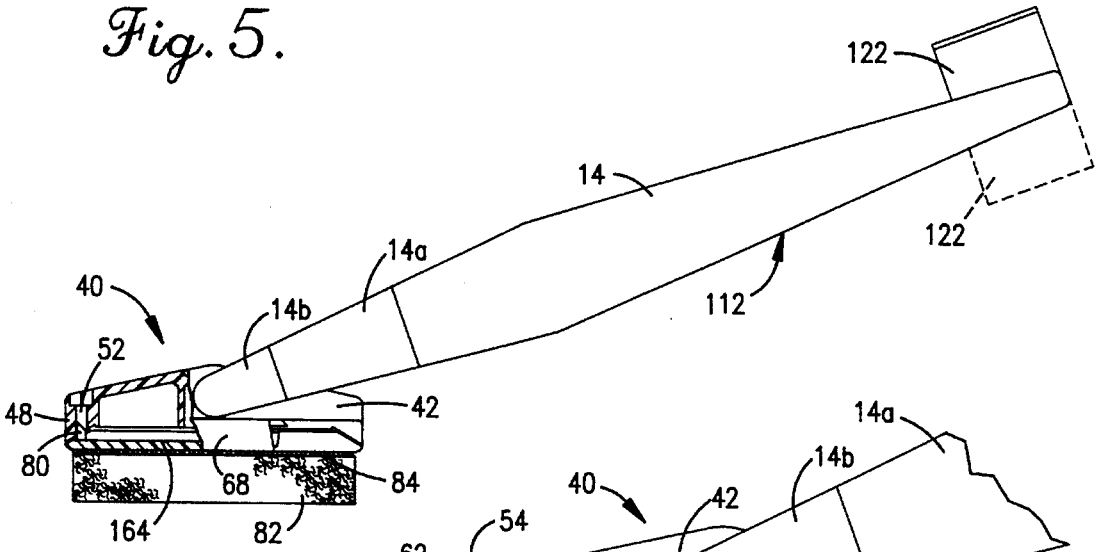
FIG. 6 is a side elevational view of the tool shown in FIG. 5, with a scrubbing pad installed and the broken lines showing an alternative position of the forearm brace.

FIG. 6 depicts an alternative base plate 164 in place on the bottom of the accessory head 40. The base plate 164 is substantially identical to base plate 64, except that it carries a scrubbing pad 82 rather than the sanding sheet 78. The scrubbing pad 82 is mounted on the bottom of plate 164 by mating hook and loop type fasteners. A sheet 84 of one type of fastener may be glued or otherwise secured to the bottom of the plate 164 (the hook fasteners for example). The pad 82 naturally adheres to these fasteners by reason of its cell structure. This allows the pad 82 to be mounted securely to the plate 164 while allowing it to be replaced by another pad when it becomes worn or otherwise ready for replacement. Scrubbing operations are carried out with a tool 10 in the same manner described previously in connection with scraping and sanding operations, and the same advantages are obtained.

Figure 5:
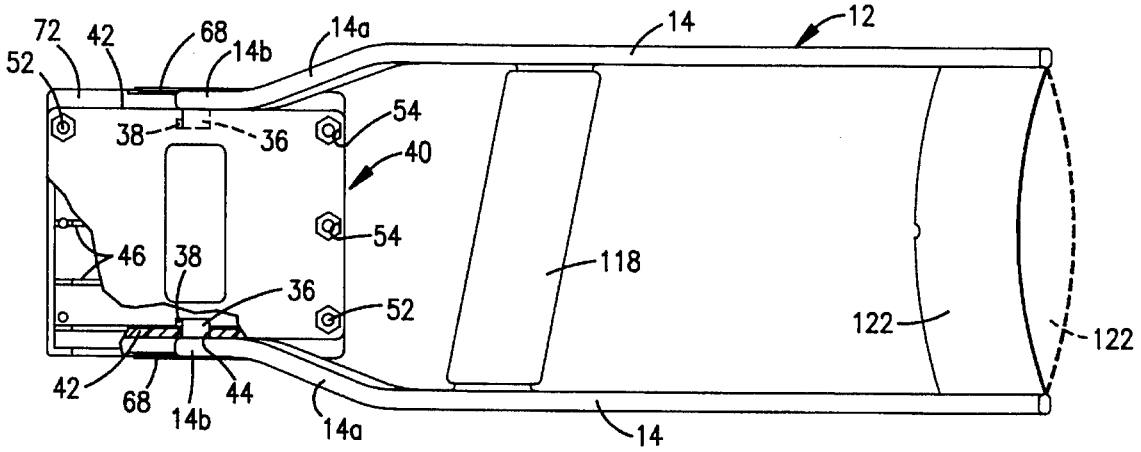
FIG. 5 is a top plan view of a modified embodiment of the tool, with a portion of the accessory head shown in section for purposes of illustration and the phantom lines showing an alternative position for the forearm brace.

With reference now to FIG. 5 in particular, a tool having a modified frame is depicted, with the only differences being that the frame 112 shown in FIG. 5 has a grip bar 118 that angles between the sides 14, and the forearm brace 122 is reversible as to its direction of concavity. The brace 122 is connected at its opposite ends with the sides 14 by means of a "living hinge" connection or a woven fabric which permits it to be snapped back and forth between the positions shown in solid lines and broken lines in FIGS. 5 and 6. In the solid line position of the brace 122, the tool is in condition to be used in the right hand of the user. The angle of the bar 118 is such that when the right hand is applied to it with the knuckles facing upwardly as viewed in FIG. 5, the index finger is advanced forwardly relative to the little finger. This provides a more natural hand grip angle for the user and allows him to use the tool in a more comfortable and effective manner. The brace 122 is in the solid line position of FIGS. 5 and 6, and the right forearm of the user acts against it in the same manner described previously.

The tool shown in FIGS. 5 and 6 can be turned upside down for use by the left hand. Then, the forearm brace 122 is snapped to the broken line position so that it can engage the top portion of the left forearm of the user. Again, due to the angle of the grip bar 118, the index finger is located slightly forwardly relative to the little finger so that a more natural angle and comfortable grip can be employed. The ice scraping head 16 or the accessory head 40 can be pivoted to the proper position when the tool is to be used in the left hand.

In this manner, the tool shown in FIGS. 5 and 6 provide an angled grip which is more comfortable and natural, and the same frame is useful equally by those who are right handed and those who are left handed.

It is thus evident that the tool of the present invention provides significant advantages in ergonomics, in effective use of leverage, in making use of both the push and pull strokes for working operations, and in relieving stress on the wrist. In addition, a single frame can be used with a number of different interchangeable working heads, and the accessory head 40 can be used alternately with the scraping blades 56, the base plate 64 which holds sand paper, or with the base plate 164 which holds the scrubbing pad.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, we claim:

1. A multiple head hand held tool assembly for treating different surfaces, said tool assembly comprising:

a rigid frame having opposite sides terminating in first and second ends;

a hand grip extending between said opposite sides at a location intermediate said first and second ends thereof;

a forearm brace extending between said first ends of the opposite sides of said frame;

a plurality of accessory heads each having means for treating a surface, said treating means being different for each accessory head; and means for releasably mounting each accessory head between said second ends of the opposite sides of the frame in a manner permitting pivotal movement of each head about a pivot axis extending between said second ends, each accessory head being releasable from said frame to permit its replacement thereon by another accessory head.

2. The tool assembly of claim 1, wherein said releasable mounting means comprises:

opposite side surfaces of each accessory head presenting keyhole slots therein; and pins on said second ends of the sides of the frame axially aligned with one another and each having a projecting lug, said pins and lugs fitting through said keyhole slots in a preselected rotative position of each accessory head and said lugs acting to retain each head on the frame in rotative positions other than said preselected position, with said pins defining said pivot axis.

3. The tool assembly of claim 1, wherein said forearm brace is located to engage the top of the forearm of a user whose hand is applied to said grip and is curved in a direction to generally conform with the curvature of the top of the forearm of the user.

4. The tool assembly of claim 1, wherein:

said treating means for one accessory head comprises a blade for scraping ice from a vehicle window.

5. The tool assembly of claim 4, wherein:

said treating means for a second accessory head comprises a metal scraping blade.

6. The tool assembly of claim 4, wherein:

said treating means for a second accessory head comprises sanding means.

7. The tool assembly of claim 4, wherein:

said treating means for a second accessory head comprises a scrubbing pad.

8. A hand held tool assembly comprising:

a rigid frame having opposite sides, each side terminating in opposite first and second ends;

a hand grip extending between said sides intermediate said first and second ends thereof at a location closer to said second ends than to said first ends;

a forearm brace extending between said first ends of the sides at a location to engage the forearm of a user whose hand is applied to said hand grip;

a scraper head having a pair of scraping edges; and means for mounting said scraper head between said second ends of the sides in a manner permitting said head to pivot about a pivot axis to allow both of said edges to remain on a surface that is being scraped, said edges being arranged such that one edge scrapes the surface during a pushing stroke of the arm and the other edge scrapes the surface during a pulling stroke of the arm.

9. The tool assembly of claim 8, wherein said forearm brace is curved between said first ends of the frame sides and is located to engage and brace the top of the forearm of a user whose hand is applied to the grip to press the scraper head against a surface to be scraped.

10. The tool assembly of claim 9, wherein said forearm brace is constructed and arranged to alternately assume different positions with the curvature thereof being opposite in the different positions to accommodate use with either the right or left hand of a user, said hand grip comprising a grip bar having a longitudinal axis oriented at an acute angle relative to said pivot axis.

11. The tool assembly of claim 8, wherein said mounting means includes means for permitting removal of said scraper head from said frame, and wherein said tool assembly comprises:

an accessory head having means for treating a surface; and releasable means for mounting said accessory head between said second ends of the sides in a manner permitting said accessory head to pivot about said pivot axis, whereby said scraper head and accessory head can be mounted interchangeably on the frame.

12. The tool assembly of claim 11, wherein said accessory head comprises:

a body adapted to be secured by said releasable means between said second ends for movement about said pivot axis;

a first base plate;

a second base plate, said treating means comprising first means on said first base plate for treating the surface and second means on said second base plate for treating the surface; and means for detachably securing said first and second base plates to said body interchangeably.

13. The tool assembly of claim 12, including a pair of scraper blades and means for detachably securing said scraper blades to opposite edge portions of said body when said first and second base plates are removed therefrom.

14. The tool assembly of claim 12, wherein:

said first treating means comprises a scrubbing pad; and said second treating means comprises a sanding sheet.

15. A hand held tool comprising:

a rigid frame having opposite sides, each side terminating in opposite first and second ends;

a hand grip extending between said sides intermediate said first and second ends thereof at a location closer to said second ends than to said first ends;

a forearm brace extending between said first ends of the sides at a location to engage the forearm of a user whose hand is applied to said hand grip, thereby allowing the application of leverage by the forearm about a fulcrum defined at the hand grip;

a working head having means for treating a surface; and means for mounting said working head between said second ends of the sides in a manner permitting said head to pivot about a pivot axis to allow said means for treating a surface to follow the surface that is being treated as the working head is moved along said surface.

* * * * *